United States Patent [19]

Onoyama et al.

[11] Patent Number: 4,552,199

[45] Date of Patent: Nov. 12, 1985

[54] APPARATUS FOR PRODUCING FLAKE PARTICLES

[75] Inventors: Takashi Onoyama, Yokohama; Osamu Ando, Kawasaki; Tsuyoshi Minakata, Yokohama, all of Japan

[73] Assignee: Nippon Yakin Kogyo Co., Ltd., Tokyo, Japan

[21] Appl. No.: 481,808

[22] Filed: Apr. 4, 1983

[30] Foreign Application Priority Data

| | | | |
|---|---|---|---|
| Apr. 8, 1982 | [JP] | Japan | 57-58515 |
| Sep. 7, 1982 | [JP] | Japan | 57-155667 |
| Feb. 8, 1983 | [JP] | Japan | 58-19170 |
| Feb. 8, 1983 | [JP] | Japan | 58-19171 |

[51] Int. Cl.[4] ..... B22D 11/06

[52] U.S. Cl. ..... 164/423; 164/429; 164/463

[58] Field of Search ..... 164/423, 427, 429, 463, 164/479; 264/5, 8; 425/8

[56] References Cited

U.S. PATENT DOCUMENTS

| | | | |
|---|---|---|---|
| 3,710,842 | 1/1973 | Mobley et al. | 164/78 |
| 3,838,185 | 9/1975 | Maringer et al. | 264/8 |
| 3,896,203 | 7/1975 | Maringer et al. | 264/165 |
| 3,904,344 | 9/1975 | Maringer et al. | 425/472 |
| 3,908,745 | 9/1975 | Caldwell et al. | 164/87 |
| 4,215,084 | 7/1980 | Maringer | 264/8 |
| 4,359,625 | 11/1982 | Okada et al. | 164/437 |

FOREIGN PATENT DOCUMENTS

| | | | |
|---|---|---|---|
| 56-148450 | 11/1981 | Japan | 164/423 |
| 82227 | 2/1956 | Netherlands | 425/8 |

*Primary Examiner*—Nicholas P. Godici
*Assistant Examiner*—Richard K. Seidel
*Attorney, Agent, or Firm*—Basile, Weintraub & Hanlon

[57] ABSTRACT

A plurality of discrete small cooling surfaces are arrayed on the surface of a movably received heat extracting member in both the axial and rotational directions. The discrete small cooling surfaces are formed by a plurality of one set of parallel grooves formed obliquely to and between the two axial ends of the heat extracting member and are crossed by a plurality of another set of parallel grooves formed in a similar manner but in different direction. An opening of a nozzle is directed toward the outer peripheral surface of the heat extracting member. A continuing stream of molten material is projected upon the discrete small cooling surfaces of the rotating heat extracting member such that the heat of the molten material is extracted by each of the discrete small cooling surface to solidify the molten material into flake particles. Accordingly, the molten material can be applied concurrently onto a plurality of discrete small cooling surfaces.

28 Claims, 31 Drawing Figures

FIG. 8
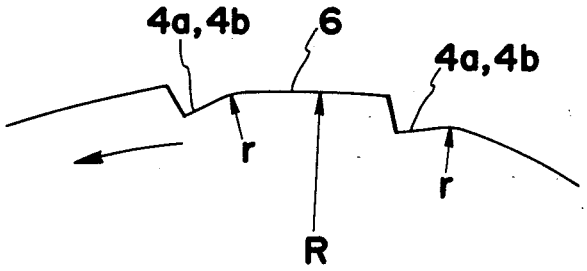
FIG.9(A)
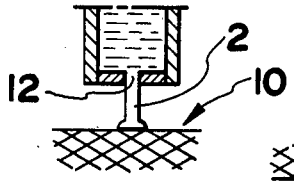
FIG.9(C)
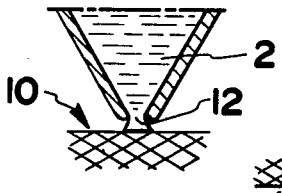
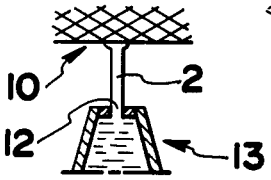
FIG.9(B)
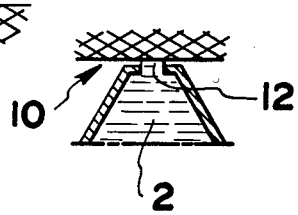
FIG.9(D)

APPARATUS FOR PRODUCING FLAKE PARTICLES

BACKGROUND OF THE INVENTION

1. Field of the Invention

This invention relates to an apparatus for producing flake particles, and more particularly, to an apparatus for carrying out the art of producing flake particles by projecting a stream of molten metallic material upon the rotating or moving surface of a heat extracting member and thereby extracting the heat from the molten material so as to solidify the metallic material into a large number of flake particles. The solidified flakes are then removed from the heat extracting member by means of centrifugal force imparted thereto by the rotation of the heat extracting member.

2. Description of the Prior Art

Heretofore, various kinds of flake particle making apparatus have been made which produce flake particles by contacting molten metal with the rotating surface of a heat extracting member and allowing the molten metal to solidify thereon.

The most typical invention known to the inventor of this application is U.S. Pat. No. 4,215,084.

According to this patent, the heat extracting member is constructed as a rotating drum, upon the outer surface of which a continuing stream of molten material is projected. The outer rotating surface of the drum is constructed with a number of serrations formed substantially parallel to the axis of rotation of the rotating drum. When a continuing thin stream of molten metal is projected upon the surface of these serrations, the heat contained in the metal is extracted by the serrations, resulting in solidification of the metal into a large number of flake particles.

Accordingly, if it is required to increase the production rate of flake particles by carrying out the process in parallel, it becomes necessary to lengthen each rotating drum and to provide a plurality of nozzles. However, it is also demanded to effect fine and correct adjustment of the nozzle opening to obtain flake particles as fine and as equal in size as possible. Such adjustment not only encounters technical difficulties, but a fine nozzle opening also results in problems with respect to service life, process control and costs.

Since such metal flake particles are most generally mixed into plastics for use as electromagnetic interference shielding materials, it is also required that the flake particles be capable of being uniformly dispersed and mixed.

However, flake particles produced by such conventional apparatus contain a considerable amount of deformed particles or smaller sized particles. Further, the particles were generally made square in shape which thereby obstructs uniform mixing and dispersion of such particles in plastic material.

The main cause for bringing about such a nonuniformity in the size and shape of the particles is due to the fact that the serrated surface of the heat extracting member is higher at the rear part of each upper surface serration than at the front part with respect to the direction of the rotation of the rotating member. Thus, the molten metal is liable to be repelled or shed which hinders a smooth transferring of the molten metal onto the heat extracting member.

Typical prior art apparatus for obtaining fine solidified metal particles are disclosed in U.S. Pat. Nos. 3,710,842, 3,838,185, 3,896,203, 3,904,344 and 3,908,745. However, all of these prior art inventions relate to methods or apparatus for producing filaments or fibers; although the aforesaid patents have a common feature with regard to the fact that high production efficiency can be performed with a low cost.

SUMMARY OF THE INVENTION

The present invention solves aforementioned problems in the prior art.

The main object of the present invention is to provide an apparatus for making flake particles, especially metal flake particles from molten material at high efficiency and low costs.

Another object of the present invention is to provide an apparatus for making flake particles which is readily controllable in operation.

A further object of the present invention is to provide an apparatus for producing flake particles which can be operated for a long service period.

A still further object of this invention is to provide an apparatus which is capable of producing flake particles of uniform shape and size.

According to the present invention, a plurality of discrete small surfaces are formed in arrays on the outer periphery of the heat extracting member in both the axial and rotational directions by engraving a plurality of grooves in one group which are parallel and extend obliquely between both of the axial ends of the heat extracting member and at an angle to both axial ends and by engraving a plurality of similar grooves of the other group which extend at a different angle to both axial ends. And yet, among the sides defining the discrete small surfaces, two of the sides are arrayed to cross the axial line of the heat extracting member.

The heat extracting member may be constructed as either a drum or an endless belt so long as it is journally received for rotational movement.

As explained, the discrete small surfaces defined on the heat extracting member can be formed by merely cutting grooves in the heat extracting member. Moreover, these discrete small surfaces, regardless of their shape, and whether formed as faces arrayed along the direction of rotation, flat faces normal to the diametrical line of the heat extracting member, or as planes higher at the rear portion with respect to the direction of rotation while being sectioned by an edge line into two surfaces both inclining downward to the axial and rotational direction, all receive molten material without repelling it from their surfaces.

The discrete small surfaces formed by crossing many grooves as mentioned above usually takes the form of a parallelogram, but surfaces can be made as triangular planes by cutting each triangle by grooves formed parallel to the axis of rotation of the heat extracting member.

Since these small surfaces are arranged in an array in the axial direction and further in a number of arrays in the peripheral direction one after another, the nozzle or orifice for projecting molten material onto these surfaces can be made with a length extending over almost the entire axial length of the heat extracting member such that the molten metal can be applied through a single nozzle or orifice onto all of the discrete small surfaces in the array.

By virtue of the fact that the molten material can be projected concurrently onto a plurality of these discrete small surfaces through the orifice or nozzle as mentioned above, the projected molten material is concurrently cooled and solidifies on each discrete small surface.

As explained above, the molten material projected through the nozzle solidifies and forms into a number of flake particles similar to the shape and size of the discrete small surfaces formed on the outer periphery of the heat extracting member.

In addition, since the nozzle or orifice of the present invention is able to be made with a width corresponding to the axial length of the heat extracting member, it is not required to make the diameter or caliber very small as is done in conventional apparatus. This makes adjustment or size controlling of the nozzle much easier and contributes to a lengthened service life of the apparatus as a whole as well as lowering its running cost.

BRIEF DESCRIPTION OF THE DRAWINGS

FIG. 8 is a schematic, elevational view showing a portion of the heat extracting member of the cylindrical drum type having a number of small discrete cooling surfaces formed on its outer surface;

FIG. 9A through FIG. 9D are fragmented, sectional views showing several types of nozzle openings;

DETAILED DESCRIPTION OF THE PREFERRED EMBODIMENTS

Figure 1:
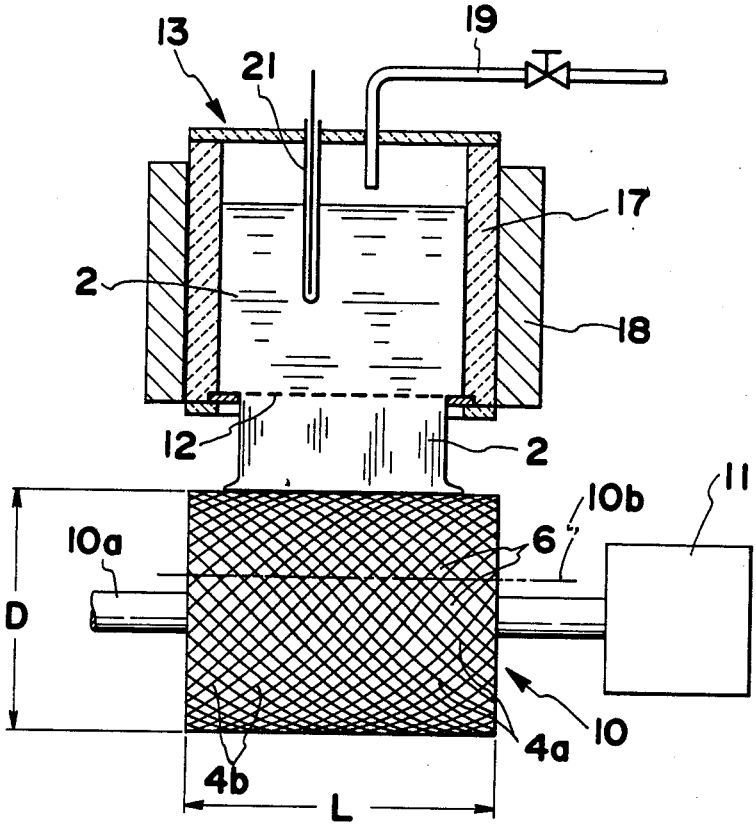
FIG. 1A is a partly cross sectioned, elevational view showing a typical embodiment of the present invention.
FIG. 1B is a cross sectional front view of a nozzle opening and the shape of the molten material being ejected through the opening.
Figure 1:
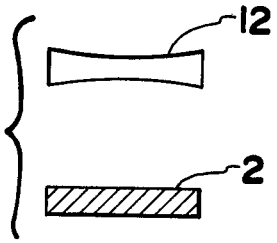

In FIGS. 1 through 24, reference numeral 10 denotes a heat extracting member formed as a drum having a substantially round cross section, the outer surface of which is made of a material having high heat conductivity and good wear resistance, such as copper chromium alloy.

A coolant, for example, water can be introduced into the interior of the heat extracting member 10. The heat extracting member or drum 10 is rotated by means of a shaft **10*a*** having a through hole (not shown) through which the coolant is introduced.

In FIG. 1, reference numeral 11 denotes a driving means coupled to the shaft **10*a* so as to rotate the heat extracting member 10 at a high speed of rotation. The driving means 11 consists of an electric motor, a transmission means and other well known devices and is capable of adjusting the rotational speed of the heat extracting member or drum 10**.

The shaft **10*a*** is connected to a means (not shown) for supplying the coolant through a swivel connection (not shown).

In FIGS. 1 through 4, a reference numeral 13 denotes a means for supplying molten material which is disposed above the heat extracting member 10 and is generally composed of a reservoir 17 made of a refractory material or materials, such as graphite and/or quartz, wrought steel or iron, and a heater 18 disposed around the reservoir 17.

At the bottom of the reservoir 17, a nozzle 12 having an elongated opening extending along the axis of the heat extracting member 10 is provided, through which a continuing stream of molten material, such as aluminum alloy, is projected in the form of a band or a ribbon upon the outer peripheral surface of the heat extracting member 10.

Since the nozzle 12 extends over the surface of the heat extracting member 10 along the axis of the heat extracting member 10, the molten material 2 is ejected as a continuous stream, as shown in FIG. 1, onto the entire surface of the width of the heat extracting member 10 in the form of a band or a curtain.

Reference numeral 19 denotes a conduit which communicates a gas supply source, not shown, with the molten metal reservoir 17. Gas, such as air or argon, is supplied from the gas supply source.

In the drawing, reference numeral 21 denotes a temperature measuring device for detecting the temperature of the molten material contained in the reservoir 17.

In FIG. 1, a large number of grooves 4*a* of one group are engraved on the outer surface of the heat extracting member 10, in parallel with each other and extending obliquely with a predetermined angle of inclination between both axial ends of the heat extracting member 10. Also, a large member of grooves 4*b* of another group are engraved on the surface of the heat extracting member 10 in a similar manner but with an angle of inclination in a different direction from that of the grooves 4*a*, such that each of the grooves 4*b* crosses the grooves 4*a*. The groups of the grooves 4*a* and 4*b* define a large number of small discrete heat extracting or cooling surfaces 6 on the outer peripheral surface of the heat extracting member 10 such that the plurality of cooling surfaces 6 are arrayed in both the rotational and axial directions of the heat extracting member 10.

In this embodiment, each of the grooves 4*a* and 4*b* defining a unit small, discrete heat extracting surface is directed to cross a line 10*b* on the surface depicted parallel to the axis of the heat extracting member 10.

Figure 3:
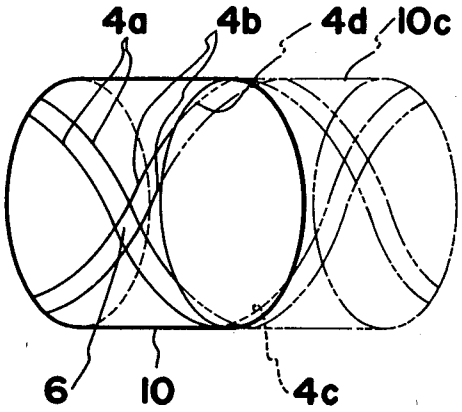
FIG. 3 is a perspective view showing a way of forming a number of small discrete surfaces on the surface of the heat extracting member by a number of spirally formed grooves.

As particularly shown in FIG. 3, the grooves 4*a* and 4*b* are formed along a pair of imaginary lines 4*c* and 4*d* going spirally around the cylindrical surface 10*c* defining the outer peripheral surface of the heat extracting member 10. All or part of the grooves 4*a* and 4*b* cross each other and form a large number of small discrete heat extracting surfaces.

Figure 2:
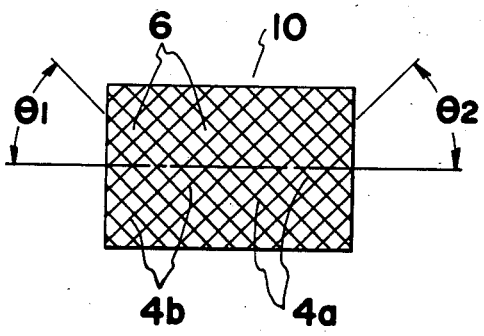
FIG. 2 is a front view of the surface of a heat extracting member in the form of a drum.

In FIG. 2 the grooves 4*a* and 4*b* are positioned at an equal angle of $\theta_1$ and $\theta_2$ of 45° to both axial end faces, namely, to the axis of the heat extracting member 10 at equal spacing. Accordingly, the shape of a small discrete cooling surface 6 defined by two pairs of grooves 4*a* and 4*b* takes the form of a square having four equal sides of length M as shown in FIG. 7A.

Figure 7A:
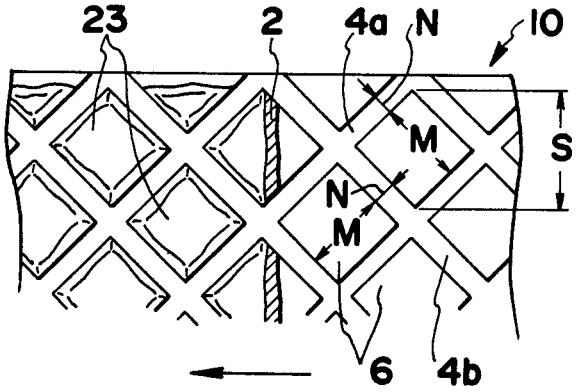
FIG. 7A is an enlarged, fragmented, plan view showing a portion of the heat extracting member.

However, the shape of the small discrete cooling surface 6 is not limited to a square as shown in the example of FIG. 7A and each of the angles $\theta_1$ and $\theta_2$ can be selected within the ranges, as shown by the formula:

$$5° < \theta_1$$

or $$\theta_2 < 85°$$

When both of the angles $\theta_1$ and $\theta_2$ are set equal but other than at 45°, the small discrete surface 6 will become a rhombus. When the angles $\theta_1$ and $\theta_2$ are set different, the discrete cooling surface 6 will become a quadrangle other than a square or rhomboid.

Since the small discrete cooling surfaces 6 are formed directly on the substantially cylindrical surface of the heat extracting member 10, they take the cross sectional configuration along the surface of the member 10 as shown in FIG. 8. In addition, a gentle slope in front of the small discrete cooling surface 6 and the crossing of the grooves 4*a* and 4*b* is connected so as to define a radius contour.

Since the discrete surface 6 is formed to have such a configuration, molten material projected upon this portion will ride exactly on each of the discrete small cooling surfaces 6 without being repelled, even if the heat extracting member 10 is rotated at a considerably high speed.

Figure 4:
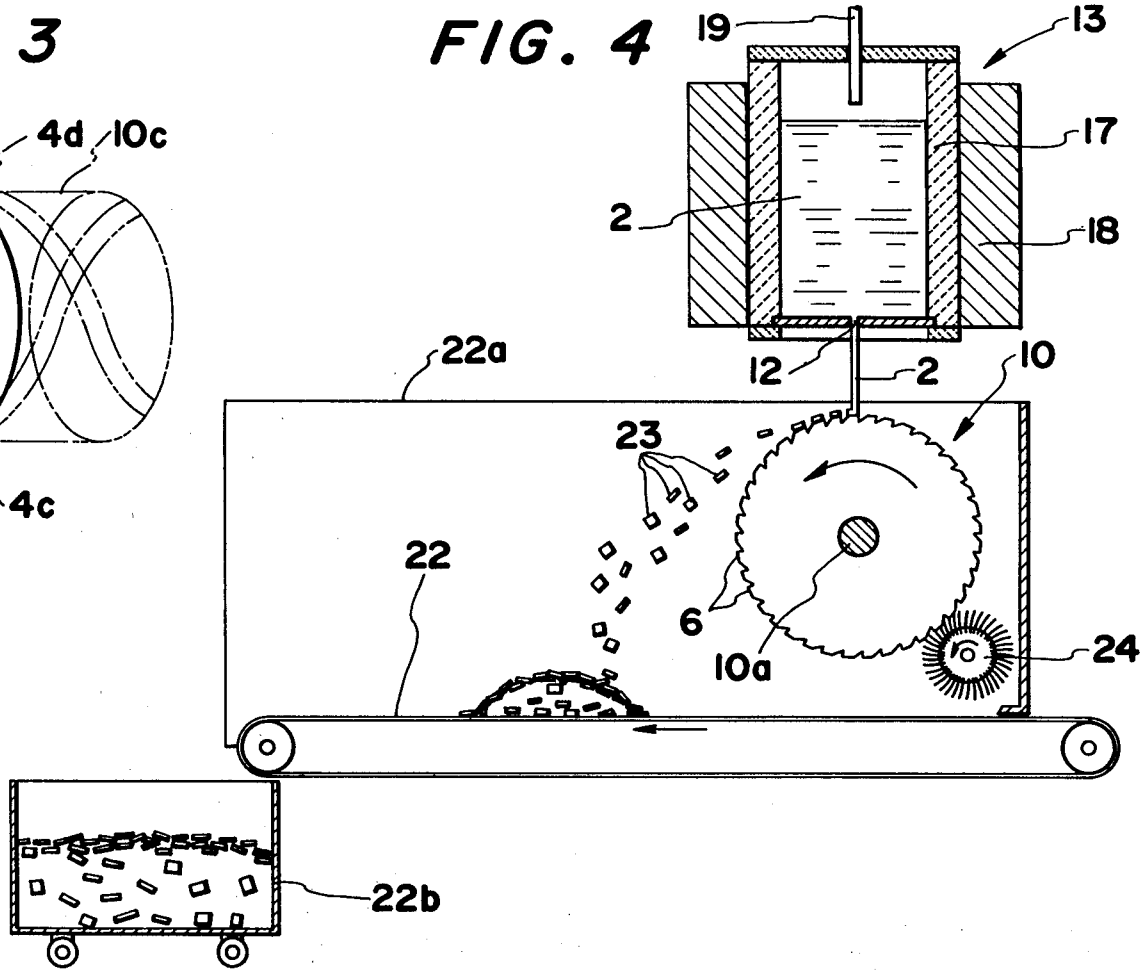
FIG. 4 is a cross sectional elevational view showing a typical embodiment of the present invention.
Figure 5:
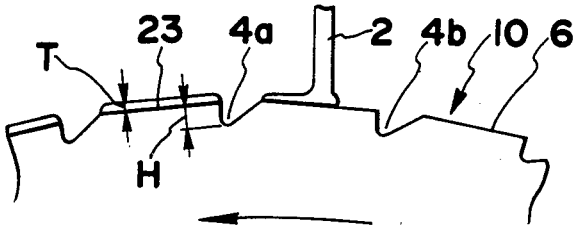
FIG. 5 is an enlarged side view showing a portion of the heat extracting member.

As can be more clearly understood from FIGS. 4, 5 and 8, the grooves 4*a* and 4*b* of the preferred embodiment are defined by two sloped walls, the one at the rear side with respect to the rotation of the heat extracting member 10 being gently sloped, while the other wall immediately forward is formed to constitute an upstanding wall of a half conduit trough.

By virtue of such a sectional configuration, the forward edge of each discrete small cooling surface 6 can be prevented from rebounding or repelling the molten impinging material continuously ejected from the orifice 12.

Figure 6:
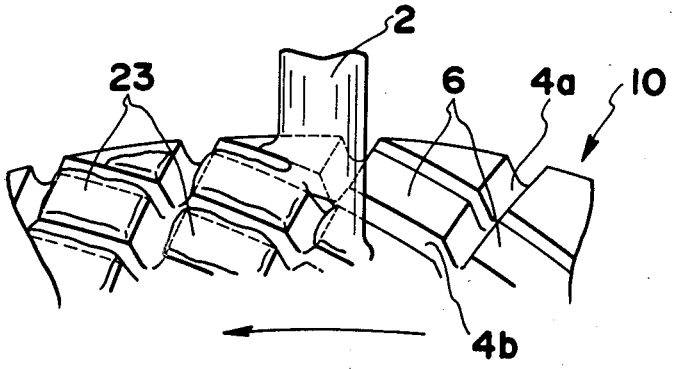
FIG. 6 is a perspective view showing a stream of the molten material being ejected onto the surface of the heat extracting member.

As shown in FIG. 6, the grooves 4*a* and 4*b* defining the discrete small cooling surface 6, of course, can be made as those having a simple trough-like configuration.

When molten material 2 is projected as a continuous stream through the nozzle 12 upon the small discrete cooling surfaces 6 of the heat extracting member 10 while it is being rotated, the molten material, as shown in FIG. 4, simultaneously contacts the plurality of discrete small cooling surfaces 6 so as to have its heat extracted by the small cooling surfaces 6. The metal 2 solidifies thereon, disintegrates, and peels off due to the centrifugal force of the rotation of the member heat extracting 10 into flake particles 23 which fall into a pile.

Although the nozzle 12 of this embodiment has a length extending almost over the axis of the heat extracting member 10 such that the molten material 2 can be projected from the single nozzle 12 located above the heat extracting member simultaneously on a plurality of the discrete small cooling surfaces 6 aligned in the axial direction, other types of nozzle constructions may also be employed.

Beneath the heat extracting member 10, a conveyor 22 is positioned to receive the flake particles 23 in a pile. The conveyor 22 is driven from time to time to transfer the piled flake particles 23 into a box 22*b* positioned immediately below the front end of the conveyor 22. In FIG. 4, reference numeral 22*a* denotes a partition plate for partitioning the right side and left side of the conveyor 22, and reference numeral 24 depicts a wiper wheel which wipes and removes the flake particles 23 which are still left on the small cooling surfaces 6 without being stripped off by the centrifugal force imparted by the rotation of the heat extracting member 10.

Figure 7B:
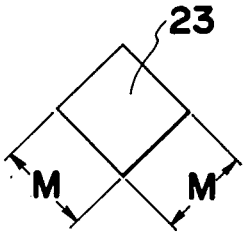
FIG. 7B is a plan view showing the shape of a flake particle formed by the present invention.

Production tests have been conducted by using the apparatus described above under the following test conditions. As a result, flake particles 23 of substantially square shape each having equal sides or two pairs of equal sides as shown in FIG. 7B were obtained.

A. Material and size of the heat extracting member 10

| Material | Copper-Chromium alloy (containing 1.5% by weight of Cr.) |
|---|---|
| Diameter (D) | 300.0 mm |
| Length (L) | 40.0 mm |

-continued

| Material | Copper-Chromium alloy (containing 1.5% by weight of Cr.) |
|---|---|
| Number of spiral grooves 4a and 4b (number of divisions) | 560 |
| Depth of the grooves 4a and 4b (H) | 0.12 mm |
| Width of the grooves 4a and 4b (N) | 0.4 mm |
| Length of the one side of the discrete small cooling surface (M) | 0.79 mm |
| Length of the diagonal of the small cooling surface (S) | 0.12 mm |

B. Condition of Test Running

| | Example I | Example II |
|---|---|---|
| Kind of Molten Material | Aluminum of 99.7% purity | Aluminum of 99.7% purity |
| Atmosphere of Melting | argon gas | air |
| Heating Temperature | 850° C. | 780° C. |
| Size of Nozzle Opening | 10.0 (1) × 0.4 mm (b) | 15.0 (1) × 0.35 (b) |
| Pressure of Projection | 0.6 Kg/cm$^2$ above atmospheric pressure | 0.8 Kg/cm$^2$ above atmospheric Pressure |
| Speed of Rotation of the heat extracting member 10 | 1800 rpm | 2200 rpm |
| Peripheral speed of the heat extracting member 10 | 28.3 m/S | 34.5 m/S |
| Material of the wiper | Cotton Cloth | Cotton Cloth |

C. Results (1) According to Example I, flake particles 23 each having a length of a side M of 0.79 mm and a thickness T of 30–40 mm, were obtained at a production efficiency of 48 Kg per hour and the average weight of each flake particle 23 was 0.060 mg.

(2) According to Example II, 68 Kg/hour of square flake particles 23 were obtained, each having a length of one side M of 0.79 mm and a thickness T of 30 to 35 microns (um).

As can be clearly observed from the examples, flake particles 23 of very fine surface area can be obtained continuously according to the present invention.

In addition, since the orifice or nozzle 12 has a considerably wide opening, there is no fear of clogging of the nozzle 12 which can be readily handled or operated with less chance of problems.

Preferably, although the length of the opening of the orifice or nozzle 12 can be selected within a range of from 1 mm to 50 mm, a longer length can also be used. Similarly, the preferable width of the opening may be 0.1 to 5 mm, but is not limited to this value.

Also, the shape of the opening of the nozzle or orifice can be modified, as shown in FIG. 1B to have its middle portion narrowed in width as compared with both of its axial ends in order to restrain the thickness of the ejected molten material at the middle portion so as to prevent it from becoming larger due to the less extent of resistance to projection as compared with the higher resistance to the ejection of molten material at both axial ends of the opening.

In the examples explained above, aluminum was used as a molten material, however, various other materials, such as copper base or nickel base alloys, iron, amorphous alloys and the like may also be used.

Figure 14:
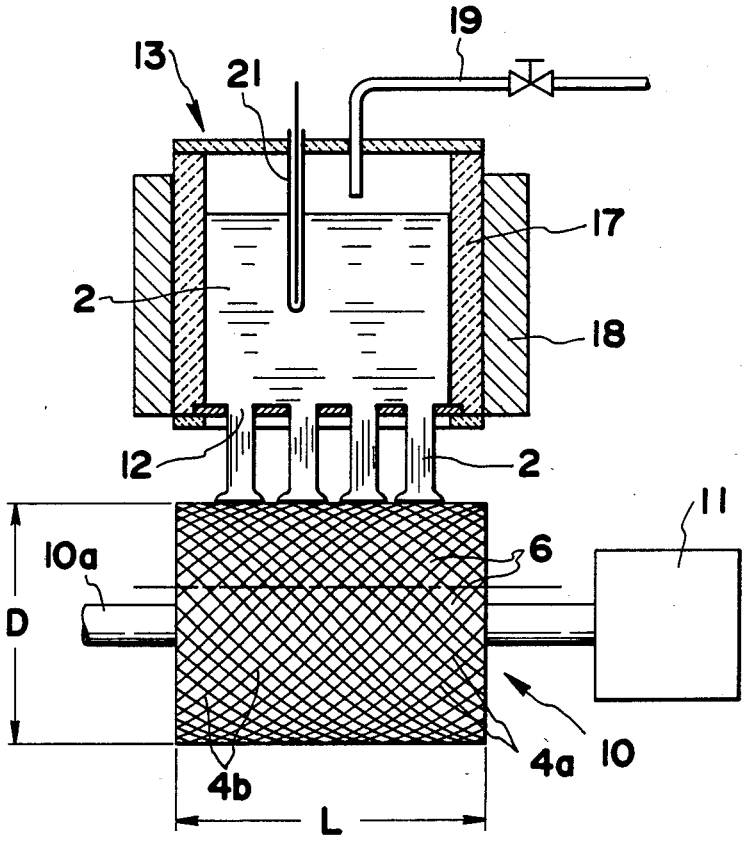
FIG. 14 is a partial, cross sectional, front view showing the present invention provided with a plurality of orifices.

FIG. 14 shows a plurality of nozzles or orifices 12 extending along the axis of the heat extracting member 10, and in the construction of this embodiment all other parts excepting the nozzles 12 are the same as shown in FIG. 1, such that a further detailed explanation will be omitted. FIG. 14 also shows that each of the streams 2 of the molten material spreads over a plurality of discrete small cooling surfaces 6.

FIGS. 15 through 18 show another embodiment of the present invention using a nozzle 12 having a projected portion **12*c* detachably attached to the molten material reservoir 17**.

Figure 15:
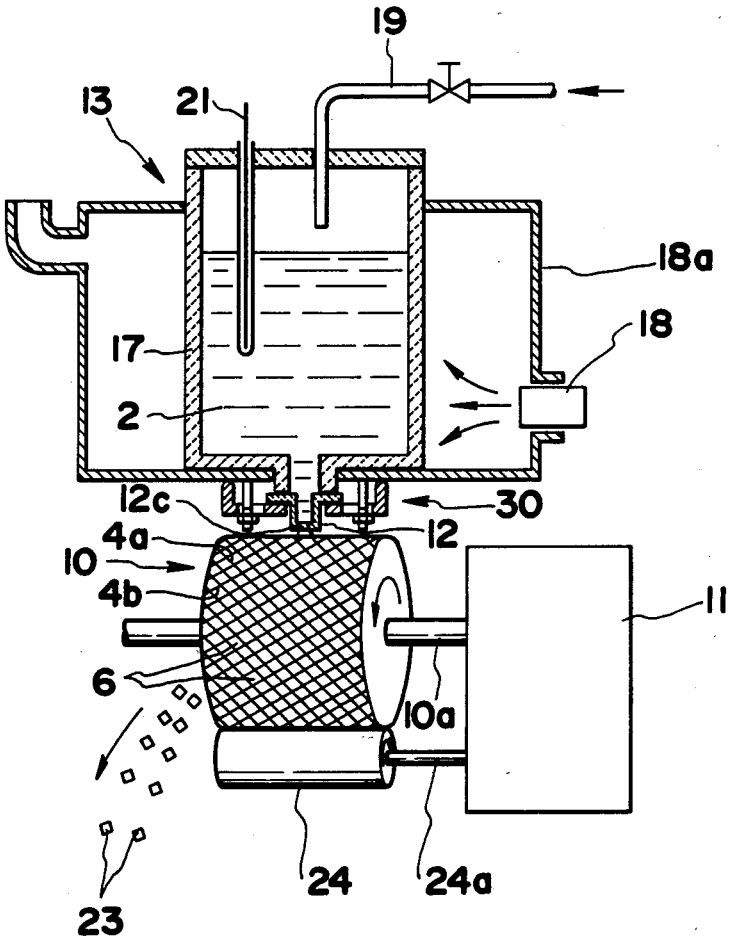
FIG. 15 is a partial, perspective, cross sectional view showing a plurality of nozzles for projecting molten material.

Especially in FIG. 15, the reservoir 17 is arranged above the heat extracting member 10 and is provided with a first heating means 18 using a burner for maintaining the temperature of the molten material received in the reservoir at a predetermined amount. A heating jacket **18*a* surrounds the heating means 18. In the drawing, a wiper wheel 24 is coupled to the driving means 11 through a shaft 24*a*. The heat extracting member 10** in this example has the same construction as that of the Example I.

Now, the construction of the nozzle 12 will be explained in detail.

Figure 16:
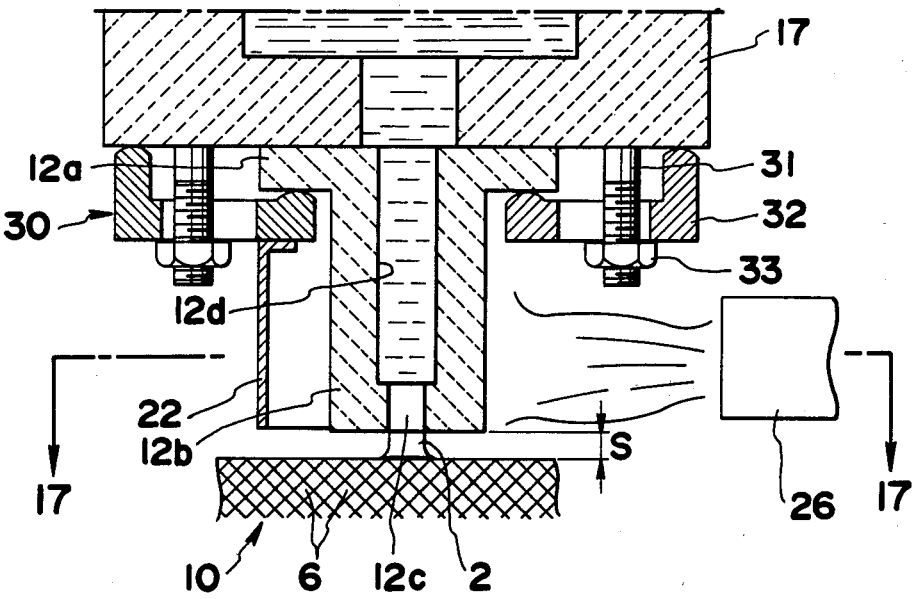
FIG. 16 is an enlarged sectional view showing a portion of the nozzle.

The molten material reservoir 17 has, at its bottom, an opening and the nozzle 12 is detachably fixed to the bottom of the reservoir 17 in alignment with the opening. As shown in FIG. 16, the nozzle 12 is composed of a flange **12*a* and a projecting cylindrical portion 12*b* formed integral with the flange 12*a* and defining at its tip end a projecting slot 12*c* of narrow elongated rectangular shape for projecting the molten material, such as aluminum or aluminum alloys, received in the reservoir 17** in the form of a band or a curtain.

As shown in FIG. 16, the nozzle 12 is positioned, at first, by aligning its axially extending bore **12*d* with the opening of the reservoir 17 and is then tightly secured to the bottom of the reservoir 17 by the aid of a fixture 30 consisting of a plurality of holding blocks 32, each having at least one oblong aperture, a plurality of stud bolts 31 threaded into the bottom of the reservoir 17 and a number of tightening nuts 33**.

The distance between the upper surface of the heat extracting member 10 and the lowermost end of the projection opening **12*c*** is selected for allowing adjustment within the range of at least 0.05 mm up to 50 mm.

Figure 17:
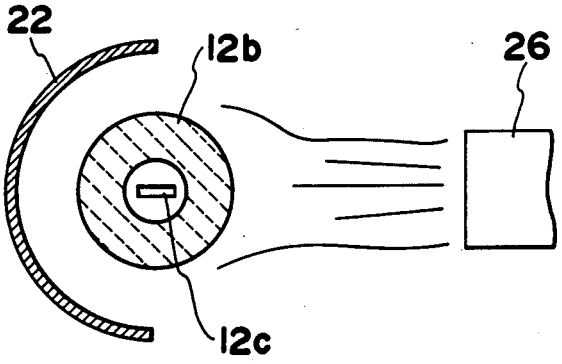
FIG. 17 is a partial, cross sectional, plan view taken along line 17—17 in FIG. 16.

In FIGS. 16 and 17, reference numeral 26 denotes a second heating means using a burner positioned such that the flame coming from the burner can heat the projecting portion **12*b* so as to prevent the molten material 2 flowing through the nozzle 12** from being cooled by the temperature of the surrounding air below the required temperature.

Reference numeral 22 denotes a reflector plate which surrounds the nozzle 12 and reflects the amount of heat supplied by the second heating means 26 toward the nozzle 12 so as to uniformly heat the projecting portion **12*b* of the nozzle 12. Such a reflecting plate 22 in practical use is fixed tightly to the holding block 32 and is bent into a semicircular cross section to cover almost half the periphery of the projecting portion 12***b*.

Figure 18:
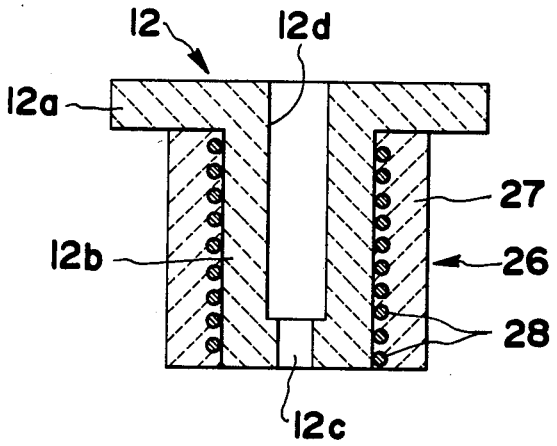
FIG. 18 is a cross sectional, elevational view of the protruding nozzle provided with a heating means.

FIG. 18 shows another form of a heating means for the nozzle 12 having a projecting portion 12*b*. In this embodiment, the second heating means 26 is integrally provided at the projecting portion 12*b* of the nozzle 12, namely, the outer surface of the projecting portion 12*b* is covered by a heat insulation material 27 within which a heater 28 is embedded so as to heat the nozzle 12 and prevent the lowering of the temperature of the molten material 2 passing through the nozzle. As an actual heating means, a heating element using a nichrome wire can be used. By constructing the nozzle 12 as shown above, a meritorious effect similar to that obtained in the embodiment depicted in FIGS. 15, 16 and 17 can be achieved.

Figure 24:
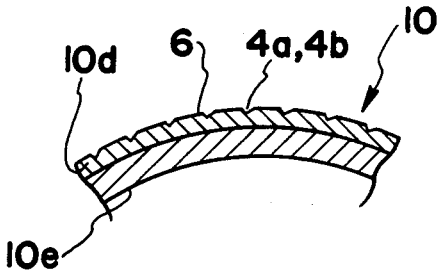
FIG. 24 is an enlarged side view showing a heat extracting drum composed of an outer peripheral member and a separately formed inner body portion.

Alternatively, as shown in FIG. 24, the heat extracting member 10 can be composed of an outer peripheral portion 10*d* and a main body portion 10*e* for supporting the peripheral portion 10*d*, so as to allow replacement of the outer peripheral portion 10*d* in case of possible wear, damage and/or repairing.

Figure 21:
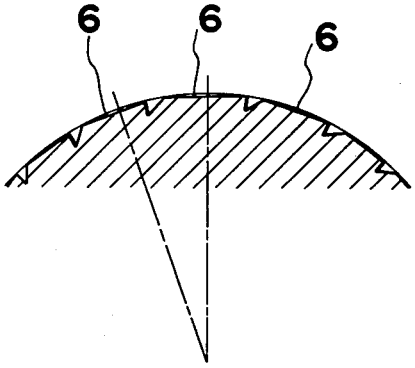
FIG. 21 is a schematic, side elevational view of a heat extracting member having each discrete, small cooling surface formed normal to each diametral line of the drum.

FIG. 21 shows an embodiment wherein the discrete small cooling surfaces 6 are formed normal to the diametric line to the center of each surface 6. By forming the discrete small cooling surfaces 6 in this manner, molten material impinging on these small surfaces 6 can be exactly applied thereon without being repelled or rebounding.

Figure 22:
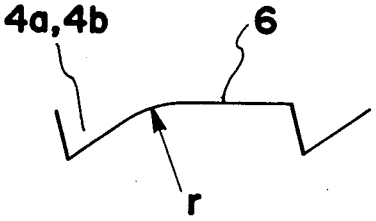
FIG. 22 is a schematic, side elevational view showing the portion of the discrete small cooling surface being connected by a radius to a gently inclined wall of a groove.

If the gentle slope at the rear side of each groove 4*a* and 4*b* with respect to the direction of rotation and each flat part of the small surfaces 6 is connected by a curved face having a radius r, as shown in FIG. 22, molten material projected on these small surface 6 can be applied more exactly thereon without being repelled or rebounding even if the heat extracting member 10 is rotated at a considerably high speed.

Figure 23:
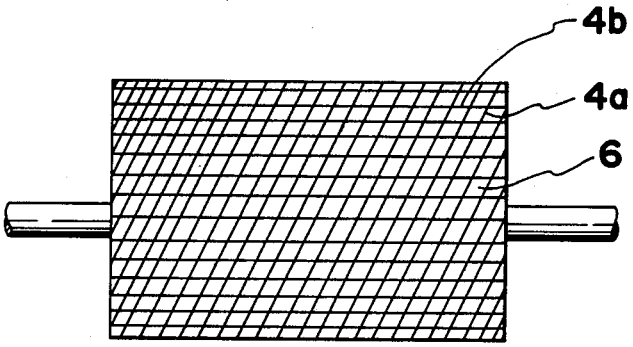
FIG. 23 is a schematic, front view wherein grooves of one of two groups of grooves crossing each other are formed in parallel with the axis of the heat extracting drum.

FIG. 23 depicts another form of a discrete small cooling surface 6. In this example, a heat extracting member 10 is formed as a cylindrical drum and one group 4*a* of the two groups of grooves crossing each other is spirally formed and the grooves of the other group 4*b* is formed in parallel with the axis of the heat extracting member 10 such that each discrete small cooling surface 6 constitutes a rhomboid.

Figure 13:
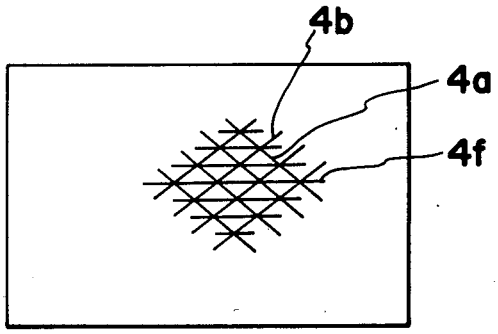
FIG. 13 is a front view showing another way of forming the discrete small cooling surfaces.

As shown in FIG. 13, each of the number of rhomboids defined by the two kinds of grooves 4*a* and 4*b* is further separated by a groove 4*f* to constitute a unit discrete cooling surface 6 of substantially triangular shape.

Figure 19:
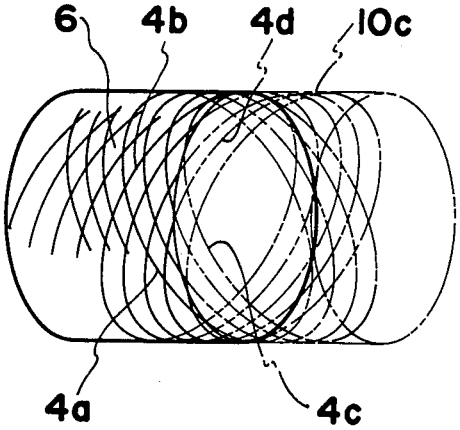
FIG. 19 is a schematic, perspective view showing a manner of forming a large number of small discrete cooling surfaces by a number of looped grooves.

FIG. 19 depicts another embodiment for forming the discrete small cooling surfaces 6. In this embodiment, the heat extracting member 10 is also formed as a cylindrical drum. Grooves 4*a* extend obliquely along the surface of the drum 10 at a certain angle, while the remaining grooves 4*b* similarly extend at another angle between the two opposite axial ends of the drum 10.

Figure 20:
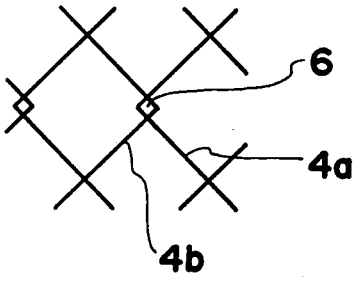
FIG. 20 is a schematic, front view showing a point where the looped grooves of FIG. 19 intersect each other.

The grooves 4*a* and 4*b* are formed by engraving them as a plurality of endless loops along the lines 4*c* and 4*d*, respectively, which are formed around the cylindrical surface 10*c* of the drum 10. In order to form discrete small cooling surfaces 6 of uniform size and shape and in as many numbers as possible, each loop 4*c* and 4*d* is required, as shown in FIG. 20, to have a portion having a sharp point as deviated from the remaining part of the looped groove.

All the looped grooves are also required to have such deviated portions with their sharp points being aligned on the same line parallel to the axis. Such a manner of positioning the looped grooves is required such that a pair of grooves 4*a* and 4*b* can form a discrete small cooling surface 6 as shown in FIG. 20 and thus enabling all other parts of grooves to form similar small cooling surfaces 6.

Figure 10:
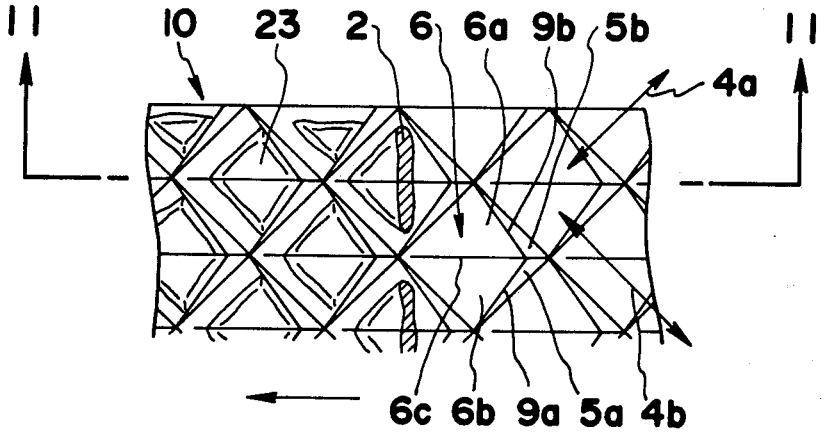
FIG. 10 is a plan view showing the surface of one embodiment of a heat extracting member.
Figure 11:
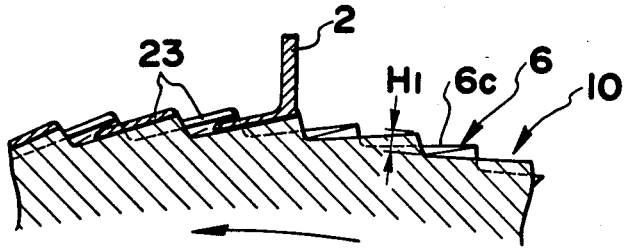
FIG. 11 is a cross sectional view taken along line 11—11 in FIG. 10.
Figure 12:
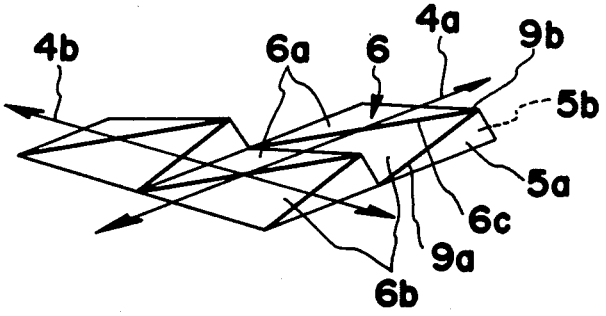
FIG. 12 is an enlarged, perspective view showing some of the discrete small cooling surfaces of one embodiment of the present invention.

FIGS. 10, 11 and 12 show another embodiment having a different type of discrete small cooling surfaces 6 instead of the aforementioned surface of square, rhomboid or other quadrangle shape sectioned by a large number of grooves 4*a* and 4*b*.

Each of such cooling surfaces 6 is composed of two gently sloped triangular faces 6*a* and 6*b* at the upper surface part and inclining down in the direction of rotation as well as to the axial direction of the heat extracting member 10. The faces 6*a* and 6*b* intersect each other to constitute a crest edge line or ridge 6*c* running in the direction of rotation of the drum 10. The triangular surfaces 6*a* are formed on grooves engraved along lines 4*a*, while the surfaces 6*b* are formed on the grooves on lines 4*b*.

The rearmost end of each gently sloped face 6*a* terminates in a steep wall 5*b* like a cliff defined by a crest line 9*a*. Similarly, the sloped face 6*b* terminates in a steep wall 5*a* being defined by a crest line 9*b*.

A pair of gently sloped faces 6*a* and 6*b* constitute a discrete small convex cooling surface 6 for forming thereon a flake particle, while each steep wall 5*a* and 5*b* acts as a step for separating each discrete convex cooling surface 6 from all neighboring cooling surfaces 6 successively formed along grooves 4*a* and 4*b*.

In the drawings, reference numeral 23 denotes a flake particle solidified on the small convex cooling face 6, while reference numeral 2 denotes a stream of molten material being projected and falling upon the same small cooling surface 6. A number of such gentle slopes 6*a* and 6*b* and the steep walls 5*b* and 5*a* are formed by cutting parallel grooves 4*b*, at first, and then by cutting or grinding off a half portion of the thus formed grooves in a transverse direction along 4*b*, or vice versa. This crossed machining will result in a large number of convex surfaces 6 separated by steps 5*a* and 5*b*.

In FIG. 9A, the nozzle 12 is formed as having a circular opening, while in FIG. 9B the nozzle 12 of circular opening is directed upward toward the heat extracting member 10 disposed above the nozzle 12 to inject the molten material 2 upwardly from a molten material supplying means 13 positioned below the heat extracting member 10.

FIG. 9C shows another type of nozzle 12 in which the outlet of the opening is positioned very close to the upper outer surface of the heat extracting member 10, while FIG. 9D shows still another type of nozzle 12 wherein the nozzle opening is positioned very close to and is directed toward the lower surface of the heat extracting member 10 disposed above the nozzle 12 so as to minimize oxidation and/or nitriding of the molten material during its flowing onto the discrete small cooling surfaces 6.

Figure 26:
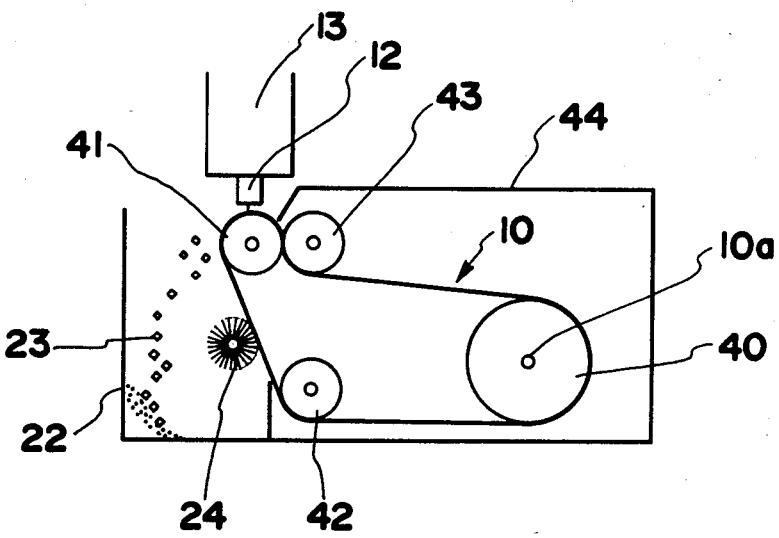
FIG. 26 is a schematic illustration of an apparatus for producing flake particles employing an endless belt type heat extracting member.

FIG. 26 shows yet another embodiment of the present invention in which the heat extracting member 10 is arranged as an endless type belt.

Figure 25:
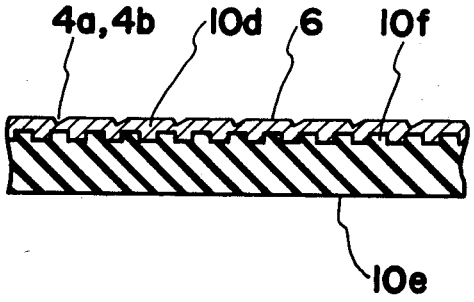
FIG. 25 is an enlarged side view showing an endless belt type heat extracting member composed of an outer heat extracting layer and a separately formed, inner supporting member.

As shown in FIG. 25, the heat extracting member 10 is composed of a body portion 10*e* made of a flexible endless metal belt, around the outer surface of which an outer endless surface member 10*d* is detachably fixed by means of a number of protrusions and grooves 10*f* disposed in the direction transverse to the movement of the belt.

On the outer surface of the outer endless surface member 10*d*, the discrete small cooling surfaces 6 are formed by forming a number of parallel grooves of one group extending obliquely to the direction of movement of the belt and forming the same number of parallel grooves of another group which obliquely cross the first group of grooves.

The heat extracting member 10 of this example is supported by a driving pulley 40 supported on an axis 10*a*, a pair of follower pulleys 41 and 42 and a tension pulley 43.

A means for supplying a molten material 13 is disposed above the heat extracting member 10 and the nozzle 12 is directed to the position where the follower pulley 41 turns the heat extracting member 10.

In the drawing, a reference numeral 44 denotes a cooling box into which a coolant is introduced to cool the heat extracting member 10. A wiper wheel 24 is disposed between the follower pulleys 41 and 42 so as to be in contact with the outer surface of the heat extracting member 10 together with a box 22*b* to surround the lower part of the follower pulley 41.

As can be clearly understood from the drawing, the box 22*b* and the portion where the follower pulley 41 confronts the nozzle 12 are substantially shielded from the interior of the cooling box 44. By moving the heat extracting member 10 constructed as described above while cooling it, the stream of molten material ejected through the nozzle 12 upon the heat extracting member 10 contacts the small cooling surfaces 6 on the heat extracting member 10 and solidifies thereon into a great number of flake particles.

In this example, too, the discrete small cooling surfaces formed on the endless belt type heat extracting member 10 can be optionally made as quadrangles, triangles or any other configuration. The nozzle 12 can also have any desired configuration.

What is claimed is:

1. An apparatus for producing flake particles from a continuous stream of projected molten material comprising:

a heat extracting member rotatably received on a shaft and having an outer peripheral surface carrying a plurality of heat extracting sections, the heat extracting sections covering the entire outer peripheral surface;

a molten material reservoir for containing the molten material;

at least one nozzle mounted on the reservoir for directing the molten material onto the outer peripheral surface of the heat extracting sections;

means for driving the heat extracting member to rotate the heat extracting sections;

each of the heat extracting sections having a discrete small cooling surface defined by two adjacent parallel and obliquely extending grooves formed on the outer surface of the heat extracting member between and with respect to both axial ends of the heat extracting member and two other parallel grooves extending in a different direction from that of the two adjacent grooves, the heat extracting sections having an essentially planar element on which the molten material solidifies;

the plurality of heat extracting sections being composed of an integrated member consisting of the unit discrete small cooling surfaces being successively arrayed in directions angularly oriented to both the axial and rotational directions of the heat extracting member; and at least two sides of the discrete small cooling surfaces cross a line parallel to the axis of the heat extracting member.

2. The apparatus for producing flake particles as claimed in claim 1 wherein the other parallel grooves extending in a different direction are those which extend parallel and obliquely at the same angle but incline opposite to the adjacent parallel grooves thereby defining each of the discrete small cooling surfaces as a parallelogram.

3. The apparatus for producing flake particles as claimed in claim 1 wherein the other parallel grooves extending in a different direction are those which extend parallel to the axis of rotation of the heat extracting member thereby defining each of the discrete small cooling surfaces as a parallelogram.

4. The apparatus for producing flake particles as claimed in claim 1 wherein each of the discrete small cooling surfaces formed substantially as quadrangles are sectioned into two halves of substantially triangular shape by a groove formed parallel to the axis of rotation of the heat extracting member.

5. The apparatus for producing flake particles as claimed in claim 1 wherein the tip end of the nozzle is oriented vertically to the axial direction of the heat extracting member with a length sufficient to apply the molten material onto the discrete small cooling surfaces aligned in the axial direction.

6. The apparatus for producing flake particles as claimed in claim 1 wherein a plurality of nozzles are disposed and aligned along the axis of rotation of the heat extracting member.

7. The apparatus for producing flake particles as claimed in claim 1 wherein the nozzle is constructed as a nozzle assembly comprising a flange detachably fixed to the molten material reservoir, a protruding body member integrally formed with the flange and directed toward the heat extracting member, and a nozzle opening provided at the tip end of the protruding body member.

8. The apparatus for producing flake particles as claimed in claim 1 wherein the space between the opening of the nozzle and the outer peripheral surface of the heat extracting member is adjustably set between the range of from 0.05 mm to 50 mm.

9. The apparatus for producing flake particles as claimed in claim 7 wherein a heating means is provided with the protruding body member.

10. The apparatus for producing flake particles as claimed in claim 1 wherein the heat extracting member is constructed as a drum.

11. The apparatus for producing flake particles as claimed in claim 1 wherein the heat extracting member is a drum and the grooves are formed along a plurality of endless loops around the cylindrical surface of the heat extracting member.

12. The apparatus for producing flake particles as claimed in claim 1 wherein the heat extracting member is a drum and the grooves are formed along a spiral line around the cylindrical surface of the heat extracting member.

13. The apparatus for producing flake particles as claimed in claim 1 wherein the heat extracting member is a drum and the grooves are formed along a plurality of spiral lines around the cylindrical surface of the heat extracting member.

14. The apparatus for producing flake particles as claimed in claim 1 wherein the discrete small cooling surfaces are formed normal to the diametral line of the heat extracting member.

15. The apparatus for producing flake particles as claimed in claim 1 wherein the heat extracting member is constructed as a drum of substantially circular cross section and each of the discrete small cooling surfaces is formed as an arcuated face along the circular peripheral surface of the drum.

16. An apparatus for producing flake particles from a continuous stream of projected molten material comprising:

a heat extracting member rotatably received on a shaft and having an outer peripheral surface carrying a plurality of heat extraction sections, the heat extracting sections covering the entire outer peripheral surface of the heat extracting member;

a molten material reservoir for containing the molten material;

at least one nozzle mounted on the reservoir for directing the molten material onto the outer peripheral surface of the heat extracting sections;

means for driving the heat extracting member to rotate the heat extracting sections;

each of the heat extracting sections being formed as a unit discrete small cooling surface defined by two adjacent parallel and obliquely extending grooves formed on the outer surface of the heat extracting member between and with respect to both axial ends of the heat extracting member and two other parallel grooves extending in a different direction from that of the two adjacent grooves, each groove composed of a first wall at the front side with respect to the direction of rotation of the heat extracting member and a second wall at the other side of the rearward of the direction of rotation of the heat extracting member and having an inclination less than the first wall;

the plurality of heat extracting sections being composed of an integrated member consisting of the unit discrete small cooling surfaces being successively arrayed in directions angularly oriented to the axial and rotational directions of the heat extracting member; and at least two sides of the discrete small cooling surfaces crossing a line parallel to the axis of the heat extracting member.

17. The apparatus for producing flake particles as claimed in claim 16 wherein the discrete small surface is connected to the second wall by a curved surface.

18. The apparatus for producing flake particles as claimed in claim 16 wherein the heat extracting member comprises an outer peripheral portion and an inner body portion supporting the outer peripheral portion and the outer peripheral portion is detachably fixed to the inner body portion.

19. An apparatus for producing flake particles from a continuous stream of projected molten material comprising:

a heat extracting member constructed as an endless belt extending between and movably received by at least two shafts, the heat extracting member having an outer peripheral surface carrying a plurality of heat extracting sections covering the entire outer peripheral surface of the heat extracting member;

a molten material reservoir for containing the molten material;

at least one nozzle mounted on the reservoir for directing the molten material onto the outer peripheral surface of the heat extracting sections;

means for driving the heat extracting member to rotate the heat extracting sections; and each of the heat extracting sections being formed as a unit discrete small cooling surface defined by a plurality of grooves cut between and obliquely transversing two opposite lengthwise edges of the heat extracting member having been crossed by a plurality of other parallel grooves extending in a similar manner but in a different direction, thereby forming a plurality of arrays in both the axial and lengthwise directions, with at least two sides defining each of the discrete cooling surfaces being positioned so as to cross the axis of rotation of the heat extracting member.

20. The apparatus for producing flake particles as claimed in claim 19 wherein the other parallel grooves in combination with the plurality of grooves form a parallelogram.

21. The apparatus for producing flake particles as claimed in claim 19 wherein the other parallel grooves extending in a different direction are parallel to the axis of rotation of the heat extracting member such that each of the discrete small cooling surfaces is formed as a parallelogram.

22. The apparatus for producing flake particles as claimed in claim 19 wherein each of the discrete small surfaces is divided by a groove extending parallel to the axis of rotation of the heat extracting member into two triangular halves.

23. The apparatus for producing flake particles as claimed in claim 19 wherein the nozzle extends in the axial direction of the heat extracting member with a length sufficient enough to apply molten material onto the plurality of discrete surfaces arrayed in the axial direction of the heat extracting member.

24. The apparatus for producing flake particles as claimed in claim 19 wherein a plurality of nozzles are arranged along the axis of rotation of the heat extracting member.

25. The apparatus for producing flake particles as claimed in claim 19 wherein the wall of the groove at the rear side is connected to the discrete small cooling surface by a curved wall.

26. The apparatus for producing flake particles as claimed in claim 19 wherein the heat extracting member comprises an outer peripheral portion and an inner body portion supporting the outer peripheral portion which is detachably fixed to the inner body portion.

27. The apparatus for producing flake particles as claimed in claim 19 wherein the wall at the rear side with respect to the direction of rotation of the heat extracting member has a lesser inclination than that of the wall at the front side and constitutes the discrete small cooling surface.

28. An apparatus for producing flake particles from a continuous stream of projected molten material comprising:

a heat extracting member constructed as an endless belt extending between and movably received by at least two shafts, the heat extracting member having an outer peripheral surface carrying a plurality of heat extracting sections covering the entire outer peripheral surface of the heat extracting member;

a molten material reservoir for containing the molten material;

at least one nozzle mounted on the reservoir for directing the molten material onto the outer peripheral surface of the heat extracting sections;

means for driving the heat extracting member to rotate the heat extracting sections;

each of the heat extracting sections being formed as a unit discrete small cooling surface defined by a plurality of grooves cut between and obliquely transversing two opposite lengthwise edges of the heat extracting member having been crossed by a plurality of other parallel grooves extending in a similar manner but in a different direction, thereby forming a plurality of arrays in both the axial and lengthwise directions, with at least two sides defining each of the discrete cooling surfaces being positioned so as to cross the axis of rotation of the heat extracting member; and the grooves being formed with spaced walls in which the wall of the groove at the rear side of each discrete small cooling surface with respect to the direction of the rotation of the heat extracting member has a lesser inclination than that of the wall at the front side of each discrete small cooling surface.

* * * * *